United States Patent [19]

Oka

[11] 4,426,435

[45] * Jan. 17, 1984

[54] PROCESS FOR FORMING AN ELECTROPHOTOGRAPHIC MEMBER HAVING A PROTECTIVE LAYER

[75] Inventor: Kozo Oka, Toyko, Japan

[73] Assignee: Rank Xerox Limited, London, England

[ * ] Notice: The portion of the term of this patent subsequent to May 3, 2000 has been disclaimed.

[21] Appl. No.: 322,792

[22] Filed: Nov. 19, 1981

[30] Foreign Application Priority Data

Mar. 2, 1981 [JP] Japan ..... 56-13779

[51] Int. Cl.[3] ..... G03G 8/00

[52] U.S. Cl. ..... 430/132; 430/66; 430/69

[58] Field of Search ..... 430/57, 58, 66, 67, 430/69, 132

[56] References Cited

U.S. PATENT DOCUMENTS

| | | | |
|---|---|---|---|
| 3,704,121 | 11/1972 | Makino et al. | 430/57 |
| 3,801,317 | 4/1974 | Tawaka et al. | 430/57 |
| 3,816,117 | 6/1974 | Kawkeiner | 430/67 |
| 3,948,657 | 4/1976 | Yoshikawa et al. | 430/67 X |
| 4,242,432 | 12/1980 | Kato et al. | 430/57 |
| 4,382,118 | 3/1983 | Oka | 430/58 |

*Primary Examiner*—John E. Kittle
*Assistant Examiner*—John L. Goodrow
*Attorney, Agent, or Firm*—Peter H. Kondo; John E. Beck; Ronald Zirelli

[57] ABSTRACT

An electrophotographic light-sensitive member comprising a conductive support, a photoconductive layer and a protective outer layer, the protective outer layer comprising at least one particulate metal oxide having a mean particle size below about 0.3 μm dispersed in an organic resin binder material. The electrophotographic light-sensitive member may be prepared by initially forming the protective outer layer and thereafter applying the photoconductive layer and conductive support thereto.

4 Claims, 3 Drawing Figures

PROCESS FOR FORMING AN ELECTROPHOTOGRAPHIC MEMBER HAVING A PROTECTIVE LAYER

This invention relates to an electrophotographic light-sensitive member and more particularly, to a process of producing an electrophotographic light-sensitive member comprising an electrically conductive support, a photoconductive layer, and a protective outer layer.

Various light-sensitive materials have been employed in electrophotography. For example, a light-sensitive layers comprising ZnO powder dispersed in an organic resin binder has been employed as a photoreceptor because of its low cost, non-toxic properties and capability of being dye sensitized. However, the repeated use of such a ZnO light-sensitive layer is accompanied by fading of the dyes, dielectric breakdown of the light-sensitive layer, toner filming on the surface of the light-sensitive layer and the like. Thus, this type of photoreceptor employed in a reusable imaging system normally has a life for making only about 1,000 copies. To overcome this deficiency, attempts have been made to form a protective layer on the surface of a light-sensitive layer. However, when such protective layers are formed by coating techniques, the coating composition tends to permeate into the ZnO light-sensitive layer to erode the binder therein and to reduce the contact state of the ZnO particles with each other, thereby inevitably resulting in degradation of the electrophotographic properties. Attempts have also been made to form a barrier layer to prevent permeation of the coating composition but an effective means has yet to be found.

Other types of light-sensitive elements have been employed for electrophotography. These include those having electrically conductive supports having thereon inorganic light-sensitive layers such as Se, Se-Te alloys and Se-As alloys, or organic photoconductive materials such as polyvinyl carbazole and 2,4,7-trinitrofluorenone. However, when these electrophotographic light-sensitive elements are repeatedly used, they are easily damaged when toner image receiving sheets are peeled from the light-sensitive elements or during the cleaning cycle. Moreover, the light-sensitive photoconductive layer surface wears away and must be replaced with new photoconductive elements within relatively short periods of time prior to significant degradation of the photoconductive characteristics. In order to minimize such defects, it has been known in the art, as discussed above, to provide a protective layer over the light-sensitive layer. One such protective layer is composed of an electrically insulating material. Such an electrically insulating layer can be made relatively thick and be selected from materials having high mechanical strength. However, in order to form an image on a light-sensitive element having an electrically insulating layer, relatively complex steps are normally employed such as, for example, charging the light-sensitive element with a first polarity, then charging the light-sensitive element with a second polarity, and exposing the light-sensitive element with a light image or charging the light-sensitive element with a first polarity, and then charging the light-sensitive element with a second polarity while simultaneously exposing the light-sensitive element to a light image, and thereafter uniformly exposing the light-sensitive element. This process requires two or more charging steps in one copying cycle and tends to increase the complexity of the imaging apparatus. This renders the characteristics of the imaging system more unstable and increases imaging costs.

In the so-called Carlson process, multiple charging steps are not required for the electrostatic latent image formation process. However, a protective layer over the electrophotographic light-sensitive element should not be highly insulating because electrostatic charges will accumulate on the surface or interior of the protected member. The technique for reducing the insulating characteristics of a protective layer is to add a quaternary ammonium salt or the like to the protective layer. Unfortunately, the electrical conductivity of such materials generally changes greatly because of moisture absorption. Moreover, the conductivity of such a protective layer tends to decrease as the layer dries, thereby causing charges to accumulate and results in fogging of toner images formed on the electrophotographic light-sensitive element. Further, under high humidity conditions, the conductivity of a protective layer can become excessive and lateral migration of charges occurs thereby causing fading of the image. In addition, the thickness of conventional protective layers must be relatively thin to the extent of several microns or less for use in the Carlson process. Protective layers which may provide satisfactory mechanical strength normally are colored when a substance is added for the purpose of increasing the electrical conductivity of the protective layer. Coloration of the protective layer undesirably influences the spectral sensitivity of the electrophotographic photosensitive member.

Attempts have been made to disperse electrically conductive powders in a binder resin to control the conductivity in a protective layer as disclosed, for example, in Japanese Patent Applications (OPI) Nos. 3338/1978, laid open on Jan. 13, 1978, and 44028/1978, laid open on Apr. 20, 1978. More specifically, when carbon or a metal is dispersed in a protecting layer, light absorption by the resulting protective layer is high and difficulty is experienced increasing the conductivity of the protective layer while maintaining the transparency of the protective layer. Further, when particles having little or no absorption to visible light, such as zinc oxide or titanium oxide are dispersed in the protective layer, the reflective index becomes non-uniform thereby greatly dispersing the light transmitted through the film to cause the formation of cloudy images. Moreover, the conductivity of these types of protective layers are not entirely satisfactory.

It is an object of this invention to provide an electrophotographic light-sensitive member having a protective outer layer which overcomes the above-noted disadvantages.

It is another object of this invention to provide an electrophotographic light-sensitive member having a protective outer layer with improved electrical properties and improved transparency.

It is another object of this invention to provide an electrophotographic light-sensitive member having a protective outer layer which exhibits excellent mechanical strength and which prolongs the life of the underlying light-sensitive layer.

It is another object of this invention to provide an electrophotographic light-sensitive member having improved thermal and chemical stability and resistance to solvents.

It is another object of this invention to provide an electrophotographic light-sensitive member which avoids accumulation of charges during repeated use.

It is another object of this invention to provide an electrophotographic light-sensitive member which is stable under changing environmental conditions.

It is another object of this invention to provide an electrophotographic light-sensitive member having improved optical properties.

The foregoing objects and others are accomplished in accordance with this invention by providing an electrophotographic light-sensitive member comprising an electrically conductive support, a photoconductive layer and a protective outer layer in which the protective outer layer comprises at least one particulate metal oxide having a mean particle size less than about 0.3 μm dispersed in a resin. Optimum transparency is achieved when the particle size is less than about 0.1 μm. Preferably, the protective outer layer comprises a powder of tin oxide and antimony oxide having a mean particle size of 0.15 μm or less dispersed in a resin binder. Optionally, an intermediate layer may be disposed between the photoconductive layer and the protective outer layer and also, optionally, an adhesive layer may be employed between the conductive layer and the photoconductive layer. The electrophotographic light-sensitive member is made by first forming the protective outer layer and thereafter applying the other layers onto the protective outer layer.

Any suitable metal oxide may be employed in the protective layer of this invention. Typical metal oxides include zinc oxide, titanium oxide, tin oxide, antimony oxide, indium oxide, bismuth oxide, tin-doped indium oxide, antimony-doped tin oxide, zirconium oxide, and the like.

When the mean particle size of the metal oxide is less than about 0.3 μm, the protective outer layer possesses transparent properties. However, a greater degree of transparency is obtained if the particle size is less than about 0.1 μm. Excellent results are achieved when the metal oxide powder contains tin oxide and antimony oxide having a mean particle size of about 0.15 μm or less. When this powder is dispersed in a resin binder material, it is possible to easily control the intrinsic resistance of the protective outer layer from about $10^{14}$ ohm-cm to $10^{9}$ ohm-cm while maintaining the desired transparency. The preferred intrinsic resistance for the protective layer is from about $10^{13}$ ohm-cm to $10^{11}$ ohm-cm and can be achieved by controlling the amount of the metal oxide powder in the protective outer layer.

The preferred powder containing tin oxide and antimony oxide of this invention is a powder in which tin oxide and antimony oxide are copresent in each powder grain. This copresence can be achieved if finely powdered antimony oxide is melt-adhered onto the surface of a tin oxide fine powder. It can also be achieved by pulverizing a solid solution of tin oxide and antimony oxide, or by other suitable techniques. The process for forming the powder should not be construed as a limiting factor in this invention. For example, powder may also be obtained by mixing pre-determined amounts of tin chloride and antimony chloride, hydrolyzing the mixture to convert it to a mixture of tin oxide and antimony oxide, washing the resulting material, calcining the washed material at about 500° C., and thereafter grinding the calcined material.

When powders containing tin oxide and antimony oxide are employed, it is desirable to control the mean particle size to about 0.15 μm or less and preferably to about 0.10 μm or less. When these ultra-fine powders are employed, a highly light-transmitting and sufficiently transparent protective outer layer can be obtained. If mean particle sizes of tin oxide and antimony oxide greater than 0.15 μm are used, light transmittance of the protective outer layer is reduced and therefore such particle sizes are less desirable. A suitable ratio of tin oxide to antimony oxide in each single powder grain is in the range of from about 98:2 to 70:30 by weight.

Any suitable binder resin for the protective outer layer of this invention may be employed. Those organic binder resins that are substantially transparent to visible light, possess excellent insulation properties, high mechanical strength and good adhesiveness are preferred. Typical resins include polyester resins, polycarbonate resins, polyurethane resins, epoxy resins, acrylic resins, silicone resins, alkyd resins, polyvinyl chloride resins, cyclic butadiene rubbers, fluorocarbon resins, polyethylene resins, polypropylene resins, vinylchloride- vinylacetate copolymers and the like. When solvent resistance of the protective outer layer is required, it is desirable to employ a thermosetting resin. A protective outer layer having excellent mechanical strength is obtained by dispersing the metal oxide in a polyethylene terephthalate resin in a fused state, extruding the resulting dispersion to form a film, and biaxially stretching the film. Optimum results are obtained when polyurethane resins are employed as the binder resin in the protective outer layer. Suitable examples of polyurethane resins include acryl-based polyurethanes, polyester-based polyurethanes, and the like. It is desirable that the amount of metal oxide be about 3 percent to about 65 percent of the weight of the resin in which the metal oxide is dispersed.

The protective outer layer of this invention is thermally and chemically stable and its characteristics are substantially unaffected by environmental changes. The protective outer layer has excellent durability and is stable with age. Moreover, the protective outer layer of this invention exhibits excellent mechanical strength such as abrasion resistance. A suitable thickness for the protective outer layer is about 2 μm to about 20 μm. However, a thickness of from about 3 μm to about 15 μm is preferred for greater transparency. Since charge carriers are generated in the photoconductive layer by exposure to light, the protective outer layer must be substantially transparent in the wavelength region to which the photoconductive layer is sensitive if exposure of the photoconductive layer is to be effected by transmission of light through the protective outer layer.

The protective outer layer may be formed by any suitable layer forming process. Typical processes for forming layers include, for example, extrusion, spray coating, dip coating, and knife coating.

Any suitable inorganic or organic photoconductor may be employed in the photoconductor of this invention. Typical inorganic photoconductors include ZnO, CdS, and the like. Other inorganic photoconductors include vapor deposited films of Se, Se-Te alloy, Se-As alloy, Se-Sb alloy, Se-Bi alloy, and the like. Typical organic photoconductors include polyvinylcarbazole which has been spectrally sensitized with a suitable sensitizer such as 2,4,7-trinitrofluorenone. Other photoconductors include organic resin binders having dispersed therein an organic photoconductor such as phthalocyanine or inorganic photoconductors such as ZnO and CdS. Moreover, the photoconductive layer may comprise a composite of a charge generation layer and a charge transport layer. An advantage of this invention is that photoconductors having a mechanical strength too low for use in conventional electrophotography can be employed with the protective outer layer of this invention.

If desired, an intermediate layer may optionally be provided between the protective outer layer and the photoconductive layer to improve adhesion and charge retention. This intermediate layer must possess electrical resistivity greater than the electrical resistivity of the protective outer layer. Although there is some latitude in the thickness of the intermediate layer, it is preferred that it be about 3 μm or less, and optimally, about 1 μm or less. The intermediate layer may function as an adhesive layer between the photoconductive layer and the protective outer layer in addition to functioning as a charge-injection inhibiting layer. Any suitable material can be used for the intermediate layer and can include those having as a major component, a polymeric organic compound or an inorganic compound. Typical examples of polymeric organic compounds include epoxy resins, polyester resins, polyamide resins, polyurethane resins, pyroxyline, vinylidene chloride resins, silicone resins, fluorocarbon resins, and the like. These may be used alone or in combinations of two or more. The intermediate layer may be formed by any suitable technique such as spray coating, dip coating, knife coating, roll coating and the like. When inorganic compounds are employed as a major component in the intermediate layer, the inorganic compound should exhibit high dark resistivity. Typical inorganic compounds exhibiting high resitivity include $SiO_2$, Se, S, $As_2O_3$, and the like.

The intermediate layer should be thin enough to transmit irradiated light therethrough to expose the photoconductive layer. Good results are obtained even with highly colored intermediate layers, if the layers are kept extremely thin. For example, selenium having a thickness of about 100 Å produces remarkable effects in reducing dark decay. The addition of small amounts of additives such as As, Sb, Bi, Te, and the like to Se will give rise to improvements in sensitivity or prevent crystalization effects. Further, the addition of elemental halogen will bring about improvements in electrical properties. The concentration of the additives should be about 20 percent by weight or less, with 15 percent by weight or less being preferred, because undesirable reduction of dark decay of the electrophotographic light-sensitive member is avoided. The inorganic intermediate layer may be formed by any suitable method such as vacuum deposition, sputtering, ion-ablating and other known methods.

Any suitable conductive member such as a film or layer may be used for the electrophotographic light-sensitive member of this invention. It may be in the form of a coating comprising a dispersion of conductive material such as carbon in a resin, or a metal layer such as aluminum, or paper treated with conductive material and an adhesive. If the conductive layer is applied to a preformed photoconductive layer containing solvent soluble components, care should be employed to avoid solvents which would erode the photoconductive layer. The conductive layer can be deposited as a coating from an aqueous solution, an aqueous adhesive, or an inorganic solvent type adhesive. Depending upon the materials employed, a conductive layer thickness between about 4 μm to about 80 μm is desirable.

BRIEF DESCRIPTION OF THE DRAWINGS

In general, the advantages of the electrophotographic light-sensitive member and method of making the member will become more apparent upon consideration of the following disclosure of the invention, particularly, when taken in conjunction with the accompanying drawings wherein.

DETAILED DESCRIPTION OF THE DRAWINGS

Figure 1:
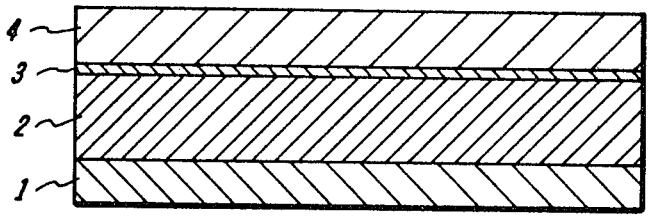
FIG. 1 is a schematic illustration of one embodiment of a device of the instant invention.
Figure 2:
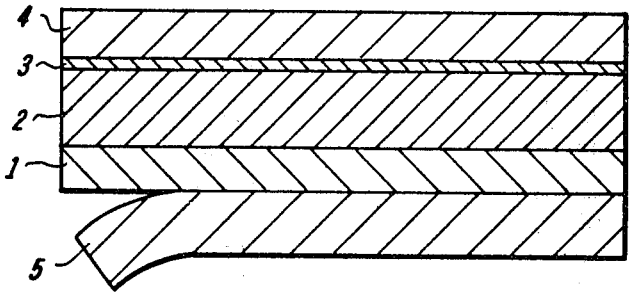
FIG. 2 illustrates a second embodiment of a device of the instant invention.
Figure 3:
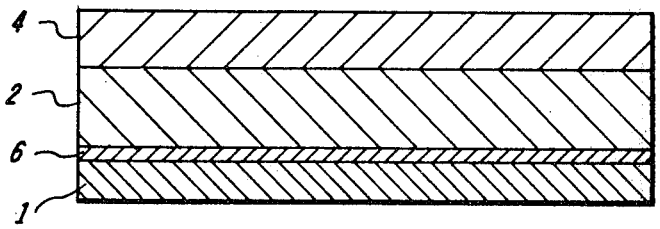
FIG. 3 illustrates a third embodiment of a device of the instant invention.

In the drawings, FIGS. 1–3 represent several variations of the electrophotographic light-sensitive member within the scope of this invention. They are all basically similar in that they comprise a protective outer layer, a photoconductive layer, and a conductive layer.

In FIG. 1, the electrophotographic light-sensitive member consists of a protective outer layer 1 comprising metal oxide particles having a mean particle size below about 0.3 μm dispersed in a resin; a photoconductive layer 2; an adhesive layer 3; and a conductive layer 4. This electrophotographic light-sensitive member may be made by initially forming a protective outer layer 1 and thereafter applying the other layers as coatings or laminates. If desired, this sequence may be reversed and the electrophotographic light-sensitive member may be manufactured by initially forming conductive layer 4.

In FIG. 2, the protective outer layer 1 is formed as a coating on release layer 5. Photoconductive layer 2 is thereafter applied to the protective outer layer 1. An adhesive layer 3 is then deposited on photoconductive layer 2. Finally, a conductive layer 4 is secured to adhesive layer 3. The release layer 5 has suitable release properties well known in the molding art and is peeled away from the protective outer layer 1. Any suitable release material may be employed in or on the surface of the release layer 5. Typical materials having release properties include fluorocarbon resins, silicone resins, polyvinyl alcohol resins, and the like. These materials may be in the form of a film or may merely be employed as a coating on the release layer 5. In the embodiment illustrated in FIG. 2, if the photoconductive layer 2 is applied to the protective outer layer 1 as a coating with the aid of a solvent, the resin used for dispersing the metal oxide particles should be selected from those that are solvent resistant. Thus, a resin that dissolves in a solvent but hardens after drying to become solvent resistant may be employed in the protective outer layer 1. Practical examples of solvent resistant resins are thermosetting and room temperature setting resins such as polyurethane resin, acrylic resin, epoxy resin, silicone resin, alkyd resin, polyester resin, vinylchloride-vinylacetate copolymer resin and the like. Thus, the protective outer layer 1 comprising metal oxide particles dispersed in a resin may be applied on the release layer 5 and thereafter hardened to such a state that the protective outer layer 1 is not eroded by any of the components of the coating compositions utilized for forming the photoconductive outer layer 2.

In FIG. 3, the electrophotographic light-sensitive member consists of a protective outer layer 1 comprising metal oxide particles having a mean particle size less than about 0.3 μm dispersed in a resin; an intermediate layer 6 comprising an organic or inorganic material having a dark electrical resistivity greater than the protective outer layer 1; a photoconductive layer 2; and a conductive layer 4. Any suitable technique may be employed for forming this electrophotographic light-sensitive member such as by initially forming the conductive layer 4, and thereafer applying the other layers as coatings or laminates.

The electrophotographic light-sensitive member of this invention is basically distinct from those known as being of the laminate or stratum type i.e., one comprising an electrically conductive support having secured thereto a photoconductive layer consisting of a charge generation layer and a charge transport layer. In other words, in the light-sensitive member of this invention, a charge pattern is formed between the interface of the protective outer layer and the photoconductive layer and the interface between the photoconductive layer and the conductive layer. In the laminate or stratum type light-sensitive member, the charge pattern is normally formed between the outer surface of the charge transport layer and the interface between the charge generation layer and electrically conductive substrate. Moreover, in the protective outer layer of this invention, the charges must be injected from the outer surface of the protective outer layer into the interface between the protective outer layer and the photoconductive layer prior to exposure, whereas the charges must be retained on the outer surface of the charge transport layer prior to exposure in the laminate or stratum type electrophotographic light-sensitive members. In addition, the protective outer layer of this invention is relatively thin compared to the photoconductive layer so that there is sufficient charge contrast potential between the exposed and unexposed surface of the electrophotographic light-sensitive member. In laminate or stratum type photoreceptors, the charge transport layer must be thicker than the charge generation layer. Thus, the configuration and properties of the layers as well as the location of the charge patterns are quite different between the electrophotographic light-sensitive members of this invention and the laminate or stratum type photoreceptors.

In view of the foregoing disclosure, it is apparent that the electrophotographic light-sensitive member of this invention need not require complex multiple charging processes to form an electrostatic latent image. Moreover, the light-sensitive member of this invention may be repeatedly used without any substantial accumulation and increase of residual charges. Further, the electrophotographic light-sensitive member of this invention is substantially uneffected by variations in temperature and moisture. If desired, the protective outer layer may be made relatively thick. Also, the sensitivity of the photoconductive layer is substantially unaffected by the protective outer layer. Moreover, the protective outer layer may be made from materials exhibiting high mechanical strength.

The following examples further specifically define the present invention with respect to the electrophotographic light-sensitive element and the method of making electrophotographic light-sensitive members. The percentages are by weight unless otherwise indicated. The examples below are intended to illustrate various preferred embodiments of the instant invention.

EXAMPLE I

A polyethylene terephthalate resin prepared by polycondensing the dimethyl ester of terephthalic acid and ethylene glycol heated in the presence of a catalyst is fused and mixed with powder of tin oxide having fused thereto antimony oxide in an amount of about 25 percent by weight. The tin oxide/antimony oxide powder has a mean particle size of about 0.05 μm. The resulting dispersion is formed into a sheet by extrusion and thereafter quenched. The sheet is then heated again, stretched about 3 times in both the longitudinal and transverse directions at 90° C. to about 100° C. and thereafter heated to about 250° C. to provide a protective outer layer film having a thickness of about 8 μm.

A dispersion is formed by ball milling about 80 parts by weight of a zinc oxide powder (Sazex 4000, made by Fakai Kagaku K.K.), about 20 parts by weight of acrylic resin (Dianarl HR-116, made by Mitsubishi Rayon K.K.), about 0.1 part by weight of Rose Bangale, about 10 parts by weight of ethanol and about 75 parts by weight of toluene for about 16 hours. The resulting dispersion is coated on the polyethyleterephthalate protective outer layer by dip coating and dried to form a light-sensitive layer having a thickness of about 20 μm. An aqueous solution of polyvinyl alcohol is then coated on the photoconductive layer to secure thereto a subsequently attached polyester film having a vapor deposited aluminum coating thereon. The assembled electrophotographic light-sensitive member is thereafter dried.

The electrostatic light-sensitive element is then repeatedly subjected to conventional electrophotographic negative charging, image exposure, development, transfer and cleaning steps. Twenty thousand sheets of copies having good images are obtained. No formation of fog in the background portions caused by desensitization are observed. For purposes of comparison, when a ZnO light-sensitive member having no protective outer layer is subjected to the same image-forming process, an increase in fog is observed after about 800 copies are made.

EXAMPLE II

About 70 parts by weight of polyurethane resin (Retan 4000, made by Kansai Paint K.K.) and about 20 parts by weight of tin oxide having a particle size below about 0.1 μm are mixed in a ball mill for about 50 hours. The resulting dispersion is coated on a fluorine resin film (Aflex, made by Asahi Glass K.K.) by dip coating and thereafter dried to form a protective outer layer having an thickness of about 6 μm after drying. A tetrahydrofuran solution containing polyvinylcarbazole and 2,4,7-trinitrofluorenone at a mole ratio of about 1:1 is coated on the aforesaid tin oxide and polyurethane protective outer layer to form a photoconductive layer having a thickness of about 15 μm. A conductive layer is then attached to the photoconductive layer in the manner described in Example I. The fluorine resin film is thereafter peeled from the protective outer layer to provide an electrophotographic light-sensitive member. When this light-sensitive member is subjected to the same image forming steps described in Example I, 20,000 copies having good images are obtained.

EXAMPLE III

About 100 parts by weight of a polyurethane resin (Retan 4000, a product of Kansai Paint Co., Ltd.), about 30 parts by weight of metal oxide powder in which the powder particles contain tin oxide onto which about 15 percent by weight antimony oxide is melt adhered, and about 100 parts by weight of Cellosolve acetate are ball milled for about 90 hours. The resulting dispersion is spray coated to form a 7 μm thick protective outer layer on a 60 μm thick photoconductive layer prepared by vapor deposition of Se on an Al drum. The thus formed electrophotographic light-sensitive member is subjected to the conventional xerographic steps of positive charging, imagewise exposure, development, transfer and cleaning. Good quality images are obtained with repeated cycles.

EXAMPLE IV

A polyamide resin (Versalon, 1175, a product of Japan Henkel Co.) is spray coated on a Se photoconductive drum identical to that described in Example III to form an intermediate layer having a thickness of about 0.4 μm. A protective outer layer containing the same ingredients employed in the protective outer layer described in Example III is then applied to the intermediate layer in the same manner as described in Example III. The resulting electrophotographic light-sensitive member is then repeatedly subjected to the copying process described in Example III. Copies bearing images having a higher image density and higher quality are obtained compared to the copy images obtained in Example III.

The invention has been described in detailed with particular reference to preferred embodiments thereof but it will be understood that variations and modifications can be effected within the spirit and scope of the invention as described hereinabove and as defined in the appended claims.

I claim:

1. A process for producing an electrophotographic light-sensitive member comprising providing a film comprising metal oxide particles having a mean particle size below about 0.3 micrometer dispersed in a resin, applying a layer of photoconductive material on said film, said film being substantially transparent in the wavelength region to which said layer of photoconductive material is sensitive, and applying a conductive layer to said layer of photoconductive material.

2. A process for producing an electrophotographic light-sensitive member comprising providing a removable member having a surface with release properties, forming a protective layer on said surface, said protective layer comprising metal oxide particles having a mean particle size below about 0.3 micrometer dispersed in an organic resin binder material, applying a layer of photoconductive material on said protective layer, said protective layer being substantially transparent in the wavelength region to which said layer of photoconductive material is sensitive, applying a conductive layer to said layer of photoconductive material, and removing said removable member from said protective layer.

3. A process for producing an electrophotographic light-sensitive member according to claim 1 wherein said film has a thickness of between about 2 micrometers and about 20 micrometers.

4. A process for producing an electrophotographic light-sensitive member according to claim 1 wherein said metal oxide particles have a mean particle size less than about 0.1 micrometer.

* * * * *